US010916393B2

(12) United States Patent
Bono et al.

(10) Patent No.: US 10,916,393 B2
(45) Date of Patent: Feb. 9, 2021

(54) ACTUATING SYSTEM FOR A VACUUM BOTTLE

(71) Applicant: Schneider Electric Industries SAS, Rueil Malmaison (FR)

(72) Inventors: Mathieu Bono, Miribel-Lanchâtre (FR); Eloïse Bonjean, Le Mottier (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/732,932

(22) Filed: Jan. 2, 2020

(65) Prior Publication Data

US 2020/0273646 A1 Aug. 27, 2020

(30) Foreign Application Priority Data

Feb. 25, 2019 (FR) ..... 19 01870

(51) Int. Cl.
*H01H 33/664* (2006.01)
*H01H 9/54* (2006.01)

(52) U.S. Cl.
CPC ..... *H01H 33/6647* (2013.01); *H01H 9/54* (2013.01)

(58) Field of Classification Search
CPC ..... H01H 9/0038; H01H 9/54; H01H 9/541; H01H 9/542; H01H 9/56; H01H 33/6647; H01H 33/6662; H02P 1/12; H02K 3/04
USPC ..... 218/118, 119, 126; 200/17 R, 11 TC
See application file for complete search history.

(56) References Cited

U.S. PATENT DOCUMENTS

| | | | | |
|---|---|---|---|---|
| 2,849,659 | A | 8/1958 | Kesselring | |
| 6,611,413 | B2 * | 8/2003 | Takeuchi | H01H 33/285 361/139 |
| 7,739,058 | B2 * | 6/2010 | Maruyama | H01F 7/1844 702/34 |
| 9,123,480 | B2 * | 9/2015 | Einschenk | H01H 3/28 |
| 9,837,229 | B2 * | 12/2017 | Chaly | H01H 47/325 |
| 9,905,348 | B2 * | 2/2018 | Kim | H01F 7/18 |
| 2010/0102035 | A1 | 4/2010 | Piccoz et al. | |

(Continued)

FOREIGN PATENT DOCUMENTS

| | | |
|---|---|---|
| DE | 4015979 | 11/1991 |
| EP | 2182536 | 5/2010 |

(Continued)

OTHER PUBLICATIONS

Search Report and Written Opinion for French Patent Application No. FR1901870, dated Nov. 12, 2019, 8 pages.

(Continued)

*Primary Examiner* — William A Bolton
(74) *Attorney, Agent, or Firm* — Locke Lord LLP

(57) ABSTRACT

A system for actuating a vacuum bottle of an electrical device, the vacuum bottle being connected in a circuit shunting a main circuit of a phase of the electrical device and comprising a movable electrode and a fixed electrode. The actuating system comprises a shunt contact which is connected to a movable contact of the main circuit during a movement of opening the electrical device, and an electromagnet whose coil is connected between the movable electrode and the shunt contact, and whose core is mechanically linked with the movable electrode, such that the core drives the movable electrode to the open position only when the value of the current which passes through the coil reaches a predetermined threshold.

13 Claims, 4 Drawing Sheets

(56) References Cited

U.S. PATENT DOCUMENTS

| | | | | |
|---|---|---|---|---|
| 2012/0048692 | A1* | 3/2012 | Piccoz | H01H 33/126 200/17 R |
| 2018/0069492 | A1 | 3/2018 | Bieringer et al. | |
| 2018/0090288 | A1 | 3/2018 | Famy et al. | |

FOREIGN PATENT DOCUMENTS

| | | |
|---|---|---|
| EP | 3300097 | 3/2018 |
| WO | WO2016169826 | 10/2016 |

OTHER PUBLICATIONS

English Language Machine Translation of German Patent Application Publication No. 4015979, published on Nov. 21, 1991, 15 pages.

* cited by examiner

ACTUATING SYSTEM FOR A VACUUM BOTTLE

TECHNICAL FIELD OF THE INVENTION

The present invention relates to a system for actuating a vacuum bottle for the purpose of opening an electrical circuit in a medium voltage or high voltage electrical device, that is to say a device operating at a voltage higher than 1000V.

The invention also relates to an electrical device comprising such an actuating system for at least one of its phases. In the present document, the term electrical device indifferently includes several types of devices such as a switch, a circuit breaker, a contactor, a switch-fuse, a recloser, a disconnector, etc.

PRIOR ART

A medium voltage or high voltage electrical device of the type described in the document EP2182536 comprises a vacuum bottle which is placed not in the main circuit comprising the main switch of a phase of the device but in a shunt circuit in parallel with that main switch. When the main switch is closed, no current therefore flows in the vacuum bottle. The latter is called upon only during an operation of opening the main circuit, with the help of an opening mechanism of the main switch which firstly makes it possible to switch the current from the main circuit to the shunt, which makes it possible to open the main switch whilst the current is wholly flowing in the vacuum bottle. The latter is then opened in its turn by the opening mechanism.

Thanks to this architecture, the vacuum tube receives a current only during the phase of opening of the main phase circuit, and not when the main switch is closed. Moreover, the vacuum bottle is not called upon during an operation of closing of the main circuit and neither does it have to withstand a possible short-circuit current, in particular when the electrical device is a switch. It just has to be capable of withstanding a transient recovery voltage TRV (TRV standing for Transient Recovery Voltage) after switching off the current in the main circuit.

The result of this is that the vacuum bottle can advantageously be simplified and designed in a much smaller size in comparison with a conventional architecture in which the vacuum bottle would be placed in the main circuit of the electrical device.

Moreover, the opening mechanism which makes it possible to switch the current from the main circuit to the shunt circuit and then to open the vacuum bottle placed in the shunt circuit must be very precise and reproducible in order to ensure on the one hand that, for each phase, the opening of the vacuum bottle is actually carried out only once the main switch is already sufficiently open in order not to risk an electric arc on the main switch by reigniting or re-striking under the effect of the TRV voltage, and on the other hand that the vacuum bottles of the different phases of the device are actually opened simultaneously.

The document EP3300097 already describes such an opening mechanism. It notably comprises a device for driving the movable electrode of the vacuum bottle. This driving device is actuated by the movable contact of the main switch by means of a mobile vane. The driving device then drives the movable electrode towards the open position, by the intermediary of an adjustment nut for adjusting the movement of the movable electrode precisely. This driving device comprises however a certain number of small mechanical parts which necessitate accurate adjustments in order to obtain good reproducibility of the system.

Moreover, one of the issues of such an actuating system is to attain performance conforming to the standards in force for the devices in question. Another issue is to minimize the number of times the vacuum bottle is called upon. In fact, during a cut-off in the main circuit of the electrical device having such an actuating system, the vacuum bottle should preferably be opened only if there really is an active load in the main circuit and the current exceeds the cut-off ability of the main movable contact. This also avoids opening the vacuum bottle systematically at each opening movement even in the absence of main current, which advantageously reduces its use and further simplifies its design.

Moreover, even if the main circuit is cut off and there is little or no main current, in certain cases capacitive charges can nevertheless remain in the cables downstream of the electrical device, and the fact that the vacuum bottle does not open in such a case makes it possible to reduce the dielectric stresses related to the capacitive charges.

One of the purposes of the invention is therefore to find a simple, reliable and economical system which on the one hand makes it possible to avoid the constraints of accurate adjustments of the parts involved in the opening of a vacuum bottle placed in a circuit shunting a main circuit of an electrical device and which, on the other hand, makes it possible to minimize the number of openings of the vacuum bottle by carrying out an opening only if necessary, that is to say if the current flowing in the main circuit of the electrical device is greater than a predetermined threshold, corresponding for example to the cut-off capability of the main contact.

DESCRIPTION OF THE INVENTION

For this purpose, the invention describes a system for actuating a vacuum bottle of an electrical device, the vacuum bottle being connected in a circuit shunting a main circuit of a phase of the electrical device and comprising a movable electrode and a fixed electrode, the movable electrode being movable between a closed position in which the two electrodes are in contact with each other and an open position in which the two electrodes are separated. The actuating system comprises:

- a shunt contact which is connected to a movable contact of the main circuit during a movement of opening the electrical device,
- an electromagnet whose coil is connected between the movable electrode and the shunt contact, and whose core is mechanically linked with the movable electrode, such that the core drives the movable electrode to the open position only when the value of the current which passes through the coil reaches a predetermined threshold.

According to one feature, the core drives the movable electrode to the open position when the current passes through the coil during at least a predetermined period of time.

According to another feature, the core is mechanically linked with the movable electrode by the intermediary of a buffer device.

According to another feature, the buffer device comprises a push rod connected to the core and cooperating with a drive part connected to the movable electrode.

According to another feature, during the movement of opening the electrical device, the push rod drives the drive part after having previously travelled a distance D between the push rod and a side of the drive part. Said predetermined period of time is determined by the distance D.

According to another feature, the actuating system comprises an electronic circuit placed in parallel with the coil and comprising an electronic switch, such that the electronic switch is in the closed position and shunts the coil as long as the value of the current which passes through the electronic circuit does not reach the predetermined threshold.

According to another feature, the actuating system also comprises a short-circuiting device which short-circuits the coil when the vacuum bottle is in the open position.

The invention also describes an electrical device comprising at least one main phase switch and a vacuum bottle placed in parallel with the main phase switch, and comprising such a system for actuating the vacuum bottle.

In the case of a multi-phase electrical device (for example three-phase) therefore having a main switch for each of the phases, the device preferably comprises a vacuum bottle in parallel with each main switch and therefore a vacuum bottle actuating system for each phase.

BRIEF DESCRIPTION OF THE FIGURES

Other features will become apparent in the following detailed description which is given with reference to the appended drawings in which.

DETAILED DESCRIPTION

Figure 1:
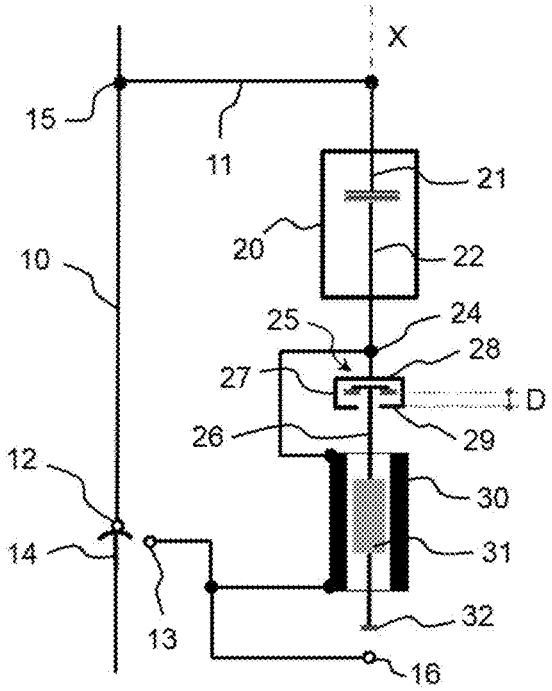
FIG. 1 shows, in the closed position, a simplified circuit diagram of a first embodiment of the switch circuit of a phase of an electrical device with an actuating system according to the invention.

FIG. 1 shows a switch circuit of a phase of an electrical device comprising a main circuit 10, a main fixed contact 12 and a main movable contact 14 (hereafter also called a movable blade 14).

The switch circuit also comprises a shunt circuit 11 which is connected in parallel with the main circuit 10, between an upstream connection point 15 and a shunt contact 13. This shunt circuit 11 comprises a vacuum bottle 20 having a fixed conductive electrode 21 (also called a fixed rod) and a movable conductive electrode 22 (also called a movable rod).

Figure 2:
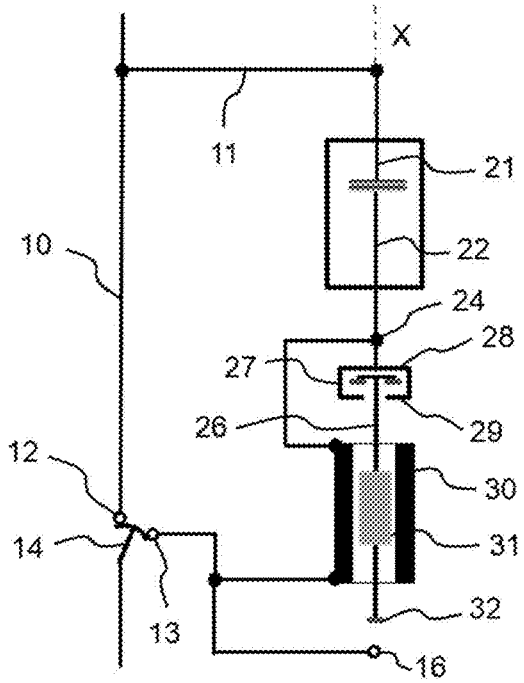
FIGS. 2 to 6 show the actuating system of FIG. 1, during the different successive steps of the movement of opening the switch circuit.
Figure 3:
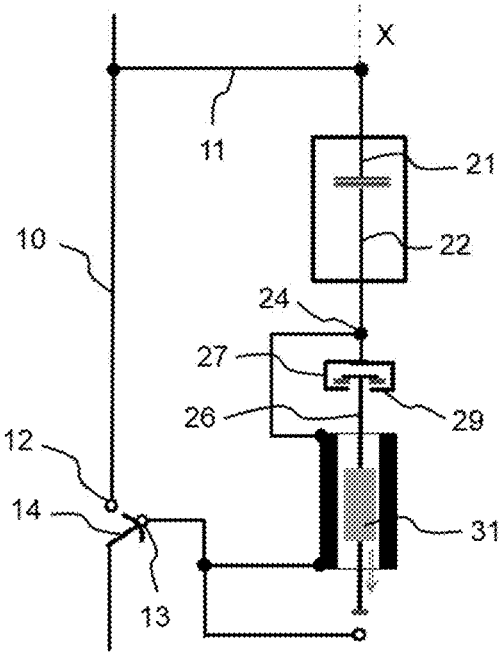
Figure 4:
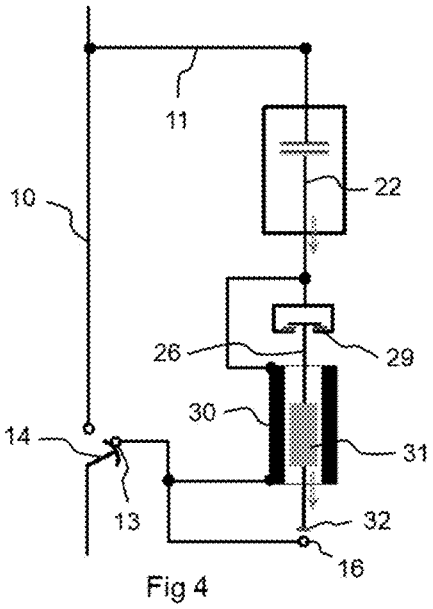
Figure 5:
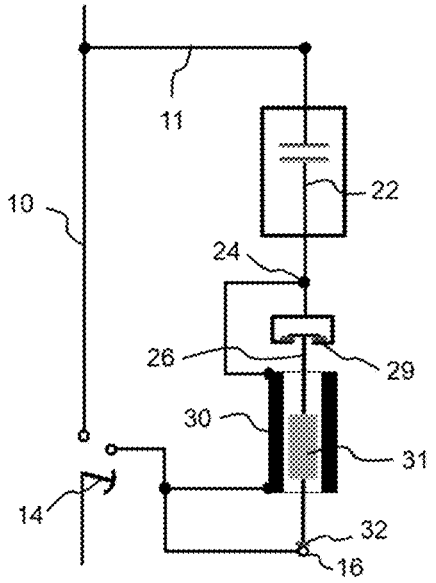

In the closed position of the main circuit 10, the movable blade 14 is in contact only with the main contact 12 and allows the flow of the current in the main circuit. No current therefore passes in the shunt circuit 11. The movement of opening the main circuit 10 takes place in several successive steps. During a first step, the movable blade 14 comes into contact with the shunt contact 13 whilst also remaining in contact with the main contact 12, as shown in FIG. 2. Then, in a following step, the movable blade 14 separates from the main contact 12 and remains in contact with the shunt contact 13, as shown in FIGS. 3 and 4. Then, in a last step, in order to come into the open position of the main circuit 10, the movable blade 14 also separates from the shunt contact 13, as shown in FIG. 5.

Optionally, for example in the case of a three-position phase switch, the switch circuit could additionally comprise an earthing contact (not shown in the figures) which the movable blade 14 would reach at the end of the open position.

The electrode 22 of the vacuum bottle 20 is movable along a longitudinal axis X between a closed position in which the two electrodes 21, 22 are in contact with each other and an open position in which the two electrodes 21, 22 are separated. The fixed electrode 21 is connected to the upstream connection point 15. Conventionally, the vacuum bottle 20 also comprises a return spring (not shown in the figures) in order to carry out the movement of closing the vacuum bottle, that is to say of returning the movable electrode 22 to its closed position.

According to the invention, the actuating system of the vacuum bottle comprises an electromagnet having an excitation coil 30 surrounding a movable metal core 31 which is actuated when a current passes through the coil 30. The coil 30 is connected at one end to the shunt contact 13 and at the other end to the movable electrode 22 at a connection point called intermediate connection point 24 (see FIG. 2). Thus, the coil 30 receives current if the vacuum bottle is in the closed position and if the movable blade 14 is in contact with the shunt contact 13. In the presence of current in the coil, the core moves along the longitudinal axis X in the direction of opening the vacuum bottle 20. In the absence of current in the coil 30, a return spring (not shown in the figures) returns the core 31 to an initial position of rest.

The movable core 31 of the electromagnet is mechanically linked with the movable electrode 22, in such a way that it drives the movable electrode 22 to the open position when a sufficient current is flowing in the coil 30. According to one embodiment, this mechanical link is formed by the intermediary of a buffer device 25 which is designed so that the core 31 actually drives the movable electrode 22 only when a sufficient current, greater than a predetermined threshold, has flowed in the coil 30 during a predetermined period of time, in order to provide the movable core with sufficient kinetic energy. The intermediate connection point 24 is situated between the movable electrode 22 and this buffer device 25. The conductor which connects the intermediate connection point 24 to the coil 30 can be flexible in order to facilitate the movement of the movable electrode 22.

According to the embodiment shown in FIGS. 2-6, the buffer device is of mechanical design and comprises a push rod 26 connected to the core 31 and a drive part 27 connected to the movable electrode 22 which cooperates with the push rod 26. The drive part 27 is for example of rectangular shape and comprises a first transverse side 28 and an opposite transverse side 29, forming a space in which one end of the push rod 26 is housed. The first transverse side 28 is connected to the movable electrode 22. The second transverse side 29 is hollowed at its centre in order to allow the push rod 26 to slide along the longitudinal axis X with respect to the part 27.

During the opening of the main circuit 10, the operating sequence of the actuating system is therefore as follows:

a) In FIG. 1, corresponding to the closed position of the main circuit 10, the blade 14 is disconnected from the shunt contact 13. Therefore, no current flows in the coil 30. The core 31 is returned into its position of rest by its return spring, the push rod 26 is not in contact with the second transverse side 29 but is separated from it by a certain distance D.

b) In FIG. 2, the movable blade 14 comes into contact with the shunt contact 13 and the vacuum bottle 20 is still closed. The shunt circuit passing through the vacuum bottle 20 and the coil 30 is therefore henceforth powered. Nevertheless, as long as the movable blade 14 remains in contact with the main contact 12, the current continues to flow principally in the main circuit 10, because of the impedance of the coil 30.

c) In FIG. 3, the movable blade 14 continues its movement and leaves the main contact 12 in order to remain connected only to the shunt contact 13. The current therefore flows henceforth in the shunt circuit. The coil 30 is powered and will be capable of driving the core 31. When the core 31 begins its movement in order to carry out an opening movement, it drives the push rod 26 which will begin by travelling the distance D before coming into contact with the second transverse side 29. Therefore, the push rod 26 does not yet drive the drive part 27 which means that, as long as the D has not been passed through, the vacuum bottle 20 remains closed, which is the case shown in FIG. 3.

It can thus be seen that there is no current flowing in the main circuit 10 during the opening of the main circuit, the drive part 27 does not move and the vacuum bottle 20 is advantageously not activated, which limits its use to the cases where it is necessary.

Moreover, the distance D advantageously provides a threshold which acts as a buffer making it possible to ensure that the current flows in the coil 30 of the electromagnet with a sufficient amplitude and for a sufficient time before beginning the opening of the vacuum bottle 20. The coil 30 of the electromagnet and the value of the distance D, which is for example of the order of a few millimetres, are configured for:

i) ensuring that the vacuum bottle 20 does not open as long as the movable blade 14 is not sufficiently separated from the main contact 12, ii) defining a predetermined current threshold, for example of the order of 30 A corresponding to the cut-off capability of the movable blade 14, before beginning the movement of opening the vacuum bottle. Moreover, it is preferably necessary for this sufficient current to also flow for a sufficient period of time. In fact, it is desired to prevent the movable electrode 22 from starting its opening movement without being able to go into its open position quickly, which could happen if the current flows in the coil 20 with a low amplitude or only during a very short time, for example because of possible current pulses generated by no-load capacitive charges during an opening of the main circuit.

The distance D therefore makes it possible to guarantee a threshold effect below which the movable contact of the vacuum bottle does not move, and above which the movable contact will fully end its movement of opening.

Moreover, the force of the return spring of the movable electrode 22 and of the return spring of the core, the mechanical inertia of the various parts and the pressure difference between the pressure in the environment outside of the bottle and the vacuum of the bottle, mean that the current flowing in the coil 30 must be sufficiently high in order to overcome these various mechanical forces and to carry out the opening movement.

d) In FIG. 4, the distance D has been exceeded, the push rod 26 and the second transverse side 29 are therefore in contact, and the movable core 31 henceforth drives the buffer device 25 and the movable electrode 22, causing the opening of the vacuum bottle.

When the movable electrode 22 separates from the fixed electrode 21, the current flowing in the coil 30 will however stop when there will no longer be an arc in the vacuum bottle and the movable core 31 will no longer be held. Nevertheless, the electromagnet is designed, notably due to its own inductance, to discharge sufficiently slowly so that the movable core 31 can keep the vacuum bottle 20 open for a sufficiently long time after the movable blade 14 separates from the shunt contact 13.

e) Moreover, the invention optionally provides a device for short-circuiting the coil 30 of the electromagnet. This device provides an end of opening contact 32 which is mechanically and electrically linked with the movable core 31. The contact 32 is not connected in the closed position of the vacuum bottle. At the end of the open position shown in FIG. 5, the end of opening contact 32 comes into contact with an end of opening terminal 16 which is connected to the shunt contact 13 and therefore to one end of the coil 30. In this configuration, the components 26 and 27 are made of a conductive material, for example of metal. In order to improve the electrical contact, contact pads can of course be provided on the parts of the push rod 26 and of the second transverse side 29 which are in contact with each other during the opening movement. Moreover, in order to ensure good electrical contact between the contact 32 and the terminal 16, a conventional contact pressure spring mechanism can obviously be used.

Figure 6:
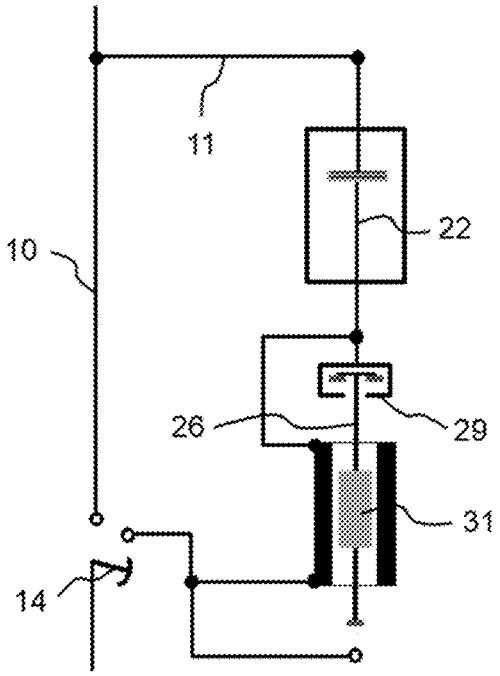

Thus, as shown in FIG. 5, this short-circuiting device has the effect of short-circuiting the power supply circuit of the coil 30, when the vacuum bottle 20 is in the open position. In fact, the self-powering circuit of the coil 30 is as follows: end of opening terminal 16, coil 30, intermediate connection point 24, push rod 26, core 31, end of opening contact 32. Thanks to this device, the keeping of the vacuum bottle 20 in an open and stable position is extended (about 1 second with the device instead of 200-300 msec) before, under the effect of its return spring, the movable core 31 returns to its initial position and the movable electrode 22 closes the vacuum bottle 20 again.

f) FIG. 6 shows the final position of the movement of opening the main circuit, namely main circuit open and return of the vacuum bottle 20 into its closed position, when the action of the return spring of the core 31 is stronger than the opening force of the electromagnet under the action of the residual current flowing in the coil 30. The end of opening contact 32 is then separated from the end of opening terminal 16 and the push rod 26 is again at a distance D from the second transverse side 29.

Figure 7:
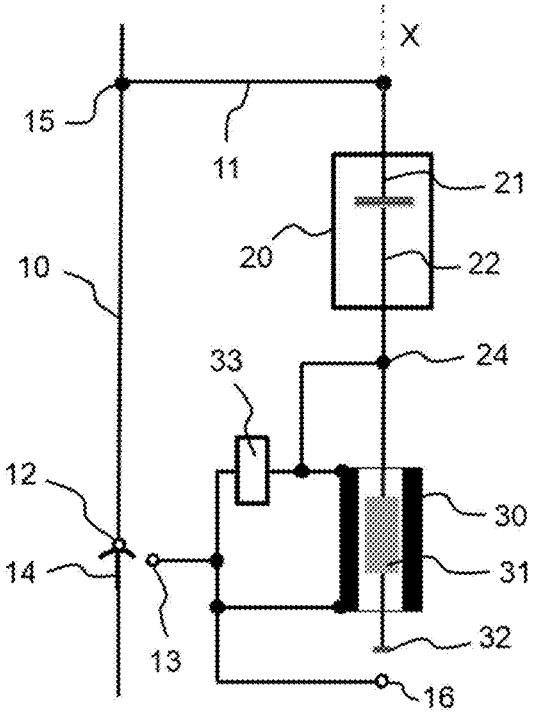
FIG. 7 shows, in the closed position, a simplified circuit diagram of another embodiment of the actuating system according to the invention.

Alternatively, the invention provides another embodiment shown in FIG. 7. In this embodiment, the buffer device is of electronic design and comprises an electronic circuit 33 in parallel with the coil 30 connected for example between the shunt contact 13 and the intermediate connection point 24. This electronic circuit 33 controls the powering of the coil 30 because it comprises an electronic switch, for example of the thyristor type, which makes it possible to shunt or not to shunt the coil 30, according to whether the electronic switch is closed or open.

When the main circuit of the device is closed, the switch of the electronic circuit 33 is closed and the coil 30 is therefore shunted, because its impedance is higher. Thus, during the movement of opening the main circuit 10, the shunt current which begins to flow in the shunt circuit will principally flow directly in the electronic circuit 33, without passing through the coil 30.

Then, if the electronic circuit 33 detects that the value of the shunt current reaches a predetermined sufficient threshold, it commands the opening of its electronic switch. The coil 30 is then powered, which will make it possible to drive the core 31 and to open the vacuum bottle 20. Thus, the electronic circuit 33 is designed for powering the coil 30, via a command to open its electronic switch, only when a certain sufficient value of current is reached. It can moreover wait for the current to flow in the shunt circuit for a sufficiently long period of time thus allowing the switching in the shunt circuit.

The switch of the electronic circuit 33 will then return to its closed position only once the final position of the movement of opening the main circuit is reached.

The electronic circuit 33 can indifferently be self-powered, powered during the switching and therefore normally closed, or it can be powered by an external source.

The invention claimed is:

1. An actuating system for actuating a vacuum bottle of an electrical device, the vacuum bottle being connected in a circuit shunting a main circuit of a phase of the electrical device and comprising a movable electrode and a fixed electrode, the movable electrode being movable between a closed position in which the two electrodes are in contact with each other and an open position in which the two electrodes are separated, the actuating system comprising:

a shunt contact which is connected to a movable contact of the main circuit during a movement of opening the electrical device, and an electromagnet whose coil is connected between the movable electrode and the shunt contact, and whose core is mechanically linked with the movable electrode, such that the core drives the movable electrode to the open position only when a value of a current which passes through the coil reaches a predetermined threshold.

2. The actuating system according to claim 1, wherein the core drives the movable electrode to the open position when the current passes through the coil during at least a predetermined period of time.

3. The actuating system according to claim 2, wherein the core is mechanically linked with the movable electrode by an intermediary of a buffer device.

4. The actuating system according to claim 3, wherein the buffer device comprises a push rod connected to the core and cooperating with a drive part connected to the movable electrode.

5. The actuating system according to claim 4, wherein, during a movement of opening the electrical device, the push rod drives the drive part after having previously travelled a distance between the push rod and a side of the drive part.

6. The actuating system according to claim 2, further comprising an electronic circuit placed in parallel with the coil and comprising an electronic switch, such that the electronic switch is in a closed position and shunts the coil as long as the value of the current which passes through the electronic circuit does not reach the predetermined threshold.

7. The actuating system according to claim 1, wherein the core is mechanically linked with the movable electrode by an intermediary of a buffer device.

8. The actuating system according to claim 7, wherein the buffer device comprises a push rod connected to the core and cooperating with a drive part connected to the movable electrode.

9. The actuating system according to claim 8, wherein, during a movement of opening the electrical device, the push rod drives the drive part after having previously travelled a distance between the push rod and a side of the drive part.

10. The actuating system according to claim 9, wherein the core drives the movable electrode to the open position when the current passes through the coil during at least a predetermined period of time, and wherein said predetermined period of time is determined by the distance.

11. The actuating system according to claim 1, further comprising an electronic circuit placed in parallel with the coil and comprising an electronic switch, such that the electronic switch is in a closed position and shunts the coil as long as the value of the current which passes through the electronic circuit does not reach the predetermined threshold.

12. The actuating system according to claim 1, further comprising a short-circuiting device which short-circuits the coil when the vacuum bottle is in the open position.

13. An electrical device comprising a main phase switch and a vacuum bottle placed in parallel with the main phase switch, wherein the electrical device comprises an actuating system for actuating the vacuum bottle according to claim 1.

* * * * *